United States Patent [19]

Spitzer et al.

[11] Patent Number: 4,874,209

[45] Date of Patent: Oct. 17, 1989

[54] ROLLING DRAWER

[75] Inventors: Charles M. Spitzer, Roslyn Heights, N.Y.; Paul F. Siegel, Ridgefied, Conn.

[73] Assignee: A-Bee Syndicate, Inc., New York, N.Y.

[21] Appl. No.: 294,817

[22] Filed: Jan. 9, 1989

[51] Int. Cl.[4] ..... A47B 91/00

[52] U.S. Cl. ..... 312/250; 16/29; 16/30

[58] Field of Search ..... 312/250, 330 R; 16/29, 16/30; 248/129

[56] References Cited

U.S. PATENT DOCUMENTS

| | | | |
|---|---|---|---|
| 441,433 | 11/1890 | Mead | 16/30 |
| 2,695,830 | 11/1954 | Oden | 312/250 X |
| 2,800,679 | 7/1957 | Schultz | 16/29 |
| 3,164,418 | 1/1965 | Biesecker | 308/3.8 |
| 3,194,610 | 7/1965 | Stewart | 308/3.8 |
| 3,214,227 | 10/1965 | Filipowicz | 312/71 |
| 3,215,476 | 11/1965 | Jacobs | 308/3.8 |
| 3,987,875 | 10/1976 | Szabo | 190/18 A |
| 3,989,128 | 11/1976 | Walker | 190/18 A |
| 4,057,872 | 11/1977 | Schmidt | 16/29 |
| 4,422,212 | 12/1983 | Sheiman et al. | 16/30 X |
| 4,449,765 | 5/1984 | Lampman | 312/311 |
| 4,579,402 | 4/1986 | Wenzlick et al. | 312/330 R |
| 4,597,122 | 7/1986 | Handler et al. | 5/503 |
| 4,744,646 | 7/1973 | Duncan et al. | 211/162 |
| 4,817,237 | 4/1989 | Murphy | 16/30 X |

*Primary Examiner*—Joseph Falk

*Attorney, Agent, or Firm*—McAulay Fisher Nissen & Goldberg

[57] ABSTRACT

A rolling drawer is disclosed having a drawer-like tray and at least one pair of wheel assemblies mounted on either side of the tray without the use of separate fasteners, tools and the like. The tray has a bottom panel and a pair of upstanding side panels connected to the side edges of the bottom panel. At least one cut-out opening is formed in the bottom panel along each of its side edges, and each side panel has an open ended slot communicating with a respective one of the cut-out openings and projecting upwardly therefrom. Each wheel assembly includes a bracket member having an elongated plate wider than the width dimension of the open ended slots and a pair of oppositely disposed L-shaped mounting lugs on the inner surface of the plate. A wheel assembly is mounted on the tray by passing the lugs through a cut-out opening in the bottom panel and moving the bracket member upwardly into a mounted position with the lugs and sides of the plate bearing against inner and outer surface portions of a side panel, respectively, located adjacent to the marginal edges of an associated slot.

11 Claims, 2 Drawing Sheets

ROLLING DRAWER

BACKGROUND OF THE INVENTION

1. Field of the Invention

This invention relates generally to a rolling drawer to store articles above a support surface. More specifically, the present invention relates to a rolling drawer, including a drawer-like tray and wheel assemblies, to support the tray for rolling movement above the support surface, and which wheel assemblies self-mount on a pair of side panels of the tray without the use of separate fasteners.

2. Description of the Prior Art

Rolling drawers, such as the free-standing drawer described in U.S. Pat. No. 4,597,122 to Handler et al., have been provided for additional storage space under room furnishings, such as beds, high-leg drawer chests and seating furniture. The free-standing drawer of Handler et al. includes a drawer that is supported for rolling contact upon a floor by a set of four wheels rotatably connected to the sides of the drawer by threaded connectors, such as wood screws. This type of wheel attachment is expensive in that if the drawer is to be assembled in a factory, the time expended in tightening each screw increases the fabrication expense of each drawer. If, on the other hand, the drawer is to be supplied in kit form for assembly by the ultimate consumer, then the consumer must provide a screw driver and must have the minimum mechanical skill necessary to attach the wheels to the drawer.

The prior art has provided devices for attaching wheels or casters to articles by interconnecting bracket assemblies. In such assemblies, the wheel or caster is rotatably connected to one component of the bracket assembly and another component of the bracket assembly is connected to the article to be supported. Examples of such devices may be found in U.S. Pat. Nos. 441,433 to Mead, 2,800,679 to Schultz, Jr., and 3,989,128 to Walker. Although the attachment of the wheels to the respective articles in these references is simplified over the wheel attachment disclosed in Handler et al, the assembly of the bracket component to the article still requires the use of screws and/or special tools. Thus, even if the teachings of these aforementioned patents were applied to the teachings of Handler et al., the disadvantages of the separate threaded fasteners of Handler et al. would not be overcome.

The prior art also has provided bracket-like devices for attaching wheels and rollers to wire-like frames, such as dishwasher racks. For instance, U.S. Pat. Nos. 3,194,610 to Stewart, 3,744,646 to Duncan et al., and 4,449,765 to Lampman disclose rollers attached to brackets that are designed to engage wire-like elements forming wire-like trays. In U.S. Pat. No. 4,057,872 to Schmidt, the elements of the wire-like tray have formed loops for connection of the brackets to the tray. As will be appreciated, the devices disclosed in these patents have no application to an article having solid panels, such as the free-standing drawer of Handler et al.

U.S. Pat. No. 3,215,476 to Jacobs discloses a roller assembly that is attached to the side wall of a sliding cabinet without the use of screws, threaded fasteners and the like. In Jacobs, the sidewall of the cabinet is provided with a key hole slot having wide and narrow portions. An axle member is provided having, at one end, a guide roller rotatably mounted thereon and, at the other end, an end portion insertable into the wide portion of the key hole opening. The insertable end portion has a reduced diameter neck portion configured to receive the edges of the narrow portion of the key hole slot.

In order to attach the roller assembly of Jacobs to the side wall of the cabinet, the reduced diameter neck portion must first be aligned with the edges of the slot. Thereafter, the axle is upwardly shifted so that the reduced neck portion engages the marginal edges of the narrow portion of the key hole slot to hold the roller assembly in place. Thus, although the attachment of the Jacobs roller assembly does not use separate connectors, such as screws, the reduced diameter neck portion of the axle member must be aligned with the edges of the key hole slot prior to the shifting of the axle member into its mounted position within the narrow portion of the key hole slot. This alignment stage of assembly is further complicated by the fact that Jacobs also discloses a circular axially yieldable flange connected to the axle member to produce a tight griping contact with the side wall of the cabinet. The initial compression of the flange increases the difficulty of aligning the reduced neck portion with the marginal edges of the narrow portion key hole slot.

The present insertion improves on the aforesaid devices by providing a rolling drawer in which wheel assemblies are removably mounted to side panels of a tray-like drawer, without the use of separate connectors, by components that self-align to further reduce assembly difficulties over the prior art.

SUMMARY OF THE INVENTION

The present invention provides a rolling drawer for storing articles. The rolling drawer includes a drawer-like tray to store the articles and at least one pair of wheel assemblies for supporting the tray for rolling movement upon a support surface.

The drawer-like tray includes a bottom panel and a pair of upstanding side panels connected to the side edges of the bottom panel. The bottom panel has at least one cut-out opening formed along each of its side edges and the side panels each have an open ended slot communicating with a respective one of the cut-out openings and projecting upwardly therefrom.

Each of the wheel assemblies comprise a wheel and a bracket member. Means are provided for rotatably connecting the wheel to the bracket member. The bracket member includes an elongated plate having a width dimension greater than the corresponding width dimension of the open ended slots. Additionally, mounting means are provided on the bracket to removably mount a separate one of the wheel assemblies to each side of the tray. The mounting means are configured to pass through one of the cut-out openings and engage the inner marginal surface portions of the associated side panel defining the edges of the open ended slot when the bracket member is moved upwardly into a mounted position on the side panel.

Since the mounting means engage the marginal surface portions of the associated side panel defining the open ended slot when the mounting means pass through the cut-out opening, the wheel assembly of the present invention is self-aligning. Thus, the rolling drawer of the present invention is easier to assemble than such prior art devices as disclosed in Jacobs, discussed above. Moreover, no separate connectors and tools are required for assembling the rolling drawer of the present invention.

Additional features and advantages of the present invention will become more apparent from a consideration of the following detailed description when taken in conjunction with the accompanying drawings.

DESCRIPTION OF THE PREFERRED EMBODIMENTS

Figure 1:
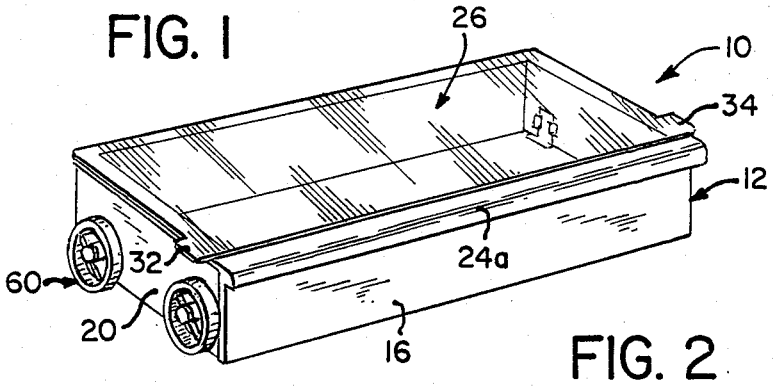
FIG. 1 is a perspective view of a rolling drawer constructed in accordance with the present invention.
Figure 2:
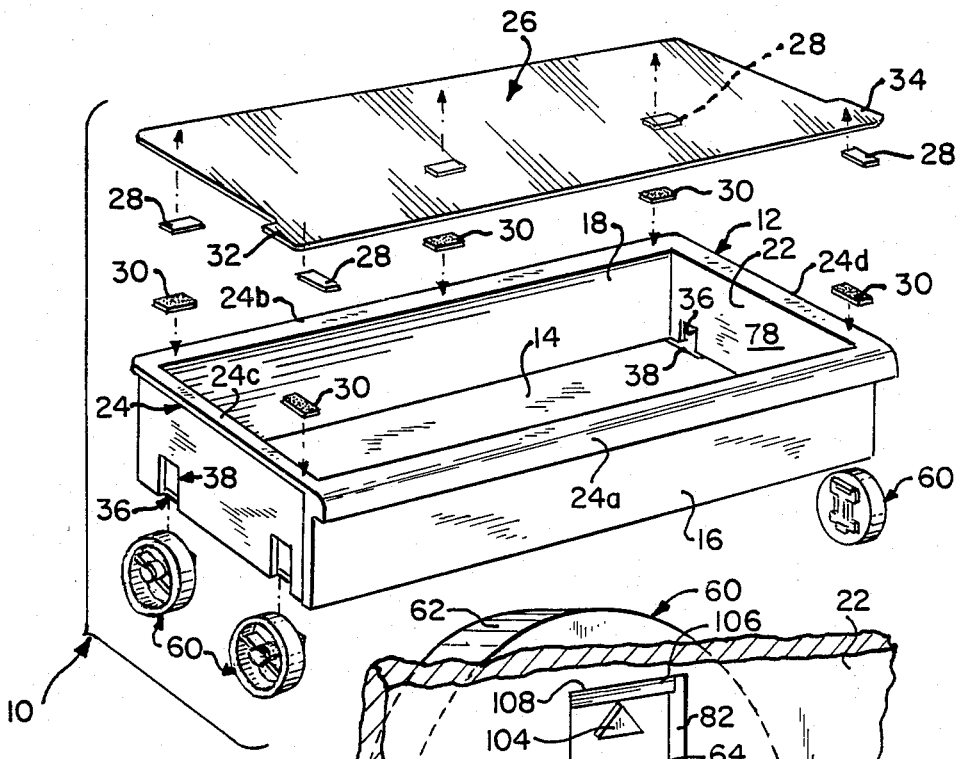
FIG. 2 is an exploded perspective view of the rolling drawer illustrated in FIG. 1.

Referring to the drawings, numeral 10 represents a rolling drawer assembly fabricated in accordance with the present invention. Drawer assembly 10 includes a drawer-like tray 12 to store articles. Tray 12 includes a bottom panel 14, a pair of upstanding front and rear panels 16 and 18 connected to the lengthwise edges of bottom panel 14 and a pair of upstanding side panels 20 and 22 connected to the side edges of bottom panel 14. Tray 12 has a top rim 24 forming the upper edges of the front, back and side panels. The rim includes a hand grip section **24*a* that constitutes the top portion of front panel 16 and a set of flat peripheral flange portions 24*b*, 24*c* and 24*d* forming the top portions of back panel 18 and side panels 20 and 22, respectively. Hand grip section 24*a* allows for the rolling drawer 10 to be easily maneuvered from under articles of room furniture, such as chairs and beds. The peripheral flange portions 24*b–d* are provided as a seat for a clear top cover 26 to cover articles stored within tray 12**.

Dust cover 26 is removably secured to the flat peripheral flange portions by means of hook and fleece sections 28 and 30. Preferrably, hook and fleece sections 28 and 30 are supplied in tape form and include a pressure sensitive contact adhesive covered by release paper prior to use. When the release paper is removed, fleece sections 30 are simply pressed into place on peripheral flange portions **24*b–d* and hook sections 28 are pressed into place at corresponding locations of cover 26. As will be appreciated, although not illustrated, the hook and hook sections 28 and 30 could be reversed with fleece sections attached to the peripheral flange portions and the hook sections attached to corresponding locations of cover 26. The front portion of cover 26 is provided with a pair of oppositely disposed, outwardly extending tabs 32 and 34 to facilitate removal of sheet 26 from tray 12**.

Tray 12 also is provided with a set of two pairs of open ended slots 36 defined in side panels 20 and 22. Bottom panel 14 is provided with a set of two pairs of spaced cut-out openings 38 formed along the side edges of bottom panel 14. Each of the open ended slots 36 communicates with respective cut-out opening 38 and projects upwardly therefrom.

Figure 3:
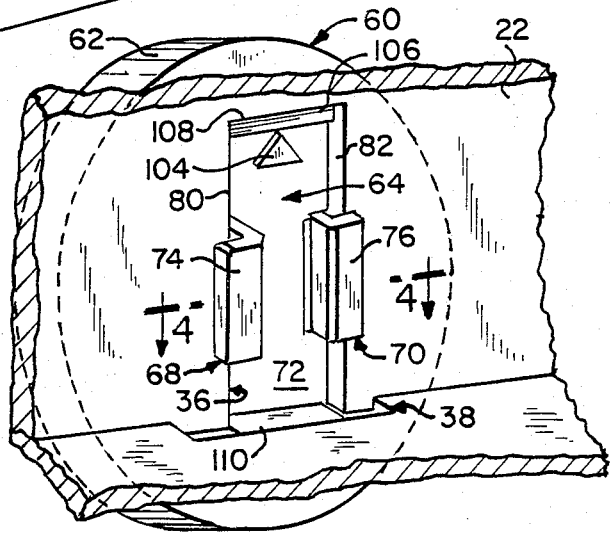
FIG. 3 is a fragmentary, perspective inside view detail of one wheel assembly constructed in accordance with the present invention, locked in place.
Figure 4:
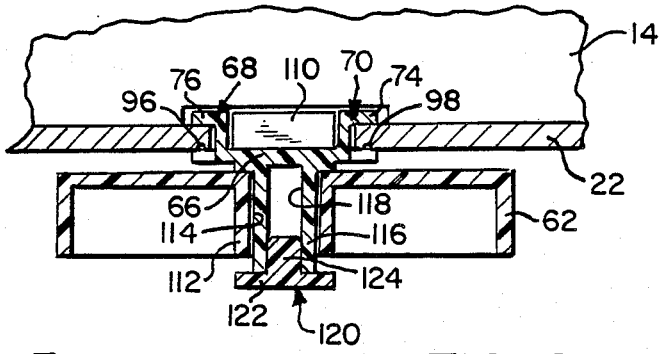
FIG. 4 is a sectional view taken along line 4—4 of FIG. 3.
Figure 5:
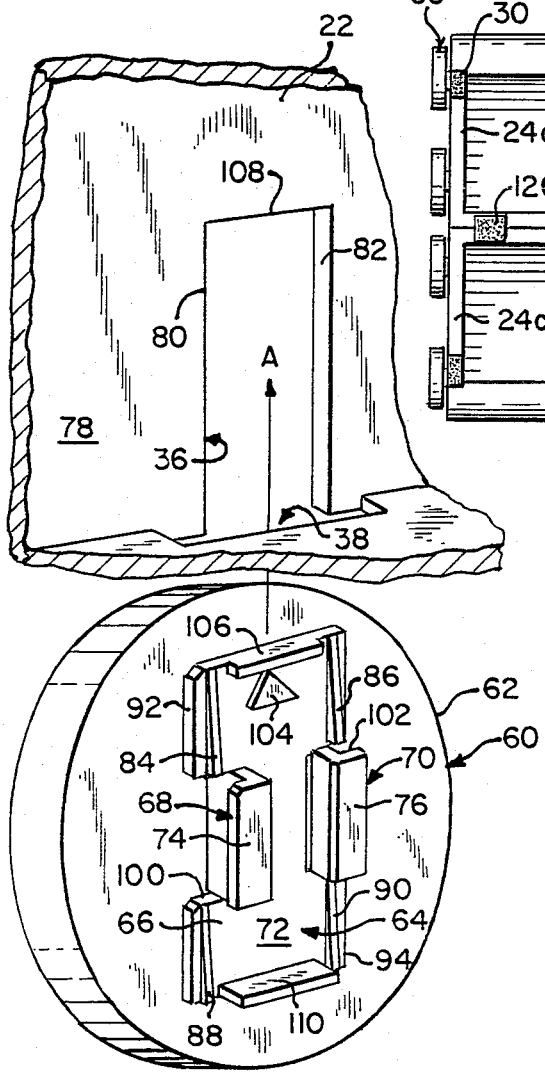
FIG. 5 is a fragmentary perspective inside view detail of the wheel assembly of FIG. 3 prior to being locked in place.

With additional reference to FIGS. 3, 4 and 5, two pairs of wheel assemblies 60 are mounted on each side of tray 12. Wheel assemblies 60 support tray 12 for rolling movement on a support surface, such as the floor of a room. Each wheel assembly 60 comprises a wheel 62 and a bracket member 64. From an unmounte position (cf. FIG. 5) bracket member 64 is moved upwardly in the direction of arrowhead "A" to a mounted position relative to open ended slot 36 (cf. FIG. 3) to removably mount a wheel assembly 60 to a side of tray 12.

Bracket member 64 includes an elongated plate 66 having width dimension greater than the width dimension of open ended slots 36. Bracket member 64 also is provided with a pair of oppositely disposed L-shaped mounting lugs 68 and 70 projecting inwardly from inner surface 72 of plate 66. Lugs 68 and 70 include base legs 74 and 76, respectively, spaced from plate surface 72 and configured to engage the inner marginal surface portions of the associated side panel which defines the edges of the open ended slot 36 when bracket member 64 is moved to its mounted position. For exemplary purposes, base legs 74 and 76 are engagable with the inner surface 78 of side panel 22 adjacent to edges 80 and 82 of the associated open ended slot 36. When mounted, base legs 74 and 76, and portions of plate 66, function in a channel-like manner to receive the marginal edge portions of side panel 22 adjacent to edges 80 and 82 which define the edges of open ended slot 36. In order to mount bracket member 64 on side wall 22, cut-out opening 38 in base panel 14 must be sized to allow passage therethrough of base legs 74 and 76.

Bracket member 64 additionally is provided with wedge-like elements 84, 86, 88 and 90 disposed along the side edges 92 and 94 thereof. The wedge-like elements 84–90 taper or slope downwardly in the direction of movement of bracket member 64 from its unmounted to its mounted position to engage outer surface portions of side panel 22 with an increasing frictional engagement as bracket member 64 is moved to its mounted position. Additionally, wedge-like elements 96 and 98, shown in FIG. 4, are provided on base legs 74 and 76, and are disposed in a facing relation to inner surface 72 of plate 66. Wedge-like elements 96 and 98 taper or slope downwardly in the direction of movement of bracket member 64 from its unmounted to its mounted position to engage the inner surface portions of panel 22 with an increasing frictional engagement as bracket member 64 is moved to its mounted position.

In order to facilitate construction of bracket member 64 by such fabrication techniques as the injection molding of plastic, side edges 92 and 94 of plate 66 are provided with a pair of oppositely disposed and inwardly directed notched portions 100 and 102. Mounting lugs 68 and 70 are disposed adjacent to notched portions 100 and 102. Additionally, wedge-like elements 84 and 88 are disposed on either side of notched portion 100, and wedge-like elements 86 and 90 are disposed on either side of notched portion 102.

In order to facilitate the assembly of drawer 10 by a consumer, plate 66 is provided with an attached arrowhead 104 to indicate the proper orientation and movement of bracket member 64 from the unmounted to the mounted positions.

In order to define the mounted position of bracket member 64 and, thus, insure the uniform positioning of bracket member 64 in any open ended slot 36, plate 66 is provided with an upper flange 106 projecting inwardly from inner surface 72 of plate 66. Flange 106 is configured to contact an upper marginal edge portion 108 of open ended slot 36 to limit upward movement of plate 66.

Additionally, plate 66 is provided with a lower flange 110 projecting inwardly from inner surface 72 of plate 66. Lower flange 110 is configured to block-off cut-out opening 38 in bottom panel 14 when bracket 64 is in its mounted position. The blocking off of cut-out opening 38 prevents articles from passing through opening 38 and, thus, prevents damage or loss of such articles.

Although the above description has been described relative to side panel 22, one open ended slot 36 defined in side wall 22 and the associated cut-out opening defined in bottom panel 14, it will be appreciated that the above description is equally applicable to the other open ended slots of side panels 20 and 22, and the associated cut-out openings of bottom panel 14.

Each of the wheels 62 is provided with a hub 112 having a bore 114 extending therethrough. A stub axle 116 projects outwardly from the outer surface of plate 66. Axle 116 is configured to be freely received within bore 114 to permit wheel 62 to rotate upon axle 116. Axle 116 is formed with a bore 118 having a free end to receive a pin 120 that acts to prevent removal of wheel 62 from axle 116 when wheel 62 is rotatably mounted in place. Pin 120 has an enlarged head 122 and a stem 124 connected to head 122. Stem 124 is configured to be frictionally received within bore 118 of axle 116 with pinhead 120 overlying the hub 112 of wheel 62.

Figure 6:
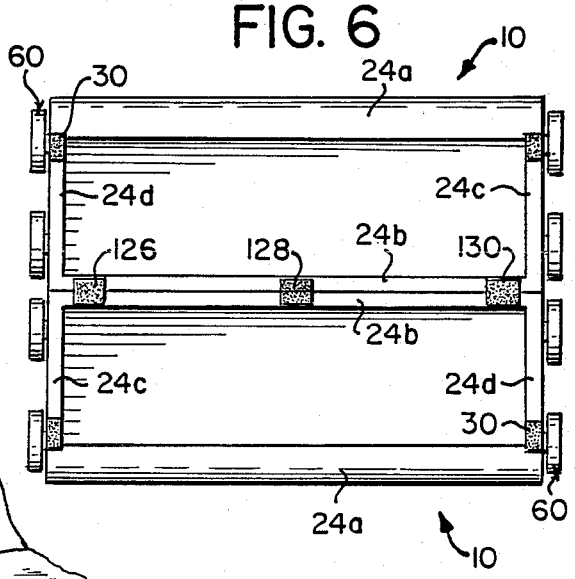
FIG. 6 is a top plan view of two rolling drawer assemblies constructed in accordance with the present invention, connected to one another.

With additional reference to FIG. 6, a pair of identical rolling drawer units 10 may be connected to one another to increase the available storage space for articles. Rolling drawers 10 are attached to one another with their back panels 18 in an abutting relationship. The attachment is accomplished by means of hook sections 126, 128 and 130 (or alternately fleece sections). Hook sections 126, 128 and 130 bridge peripheral flange section **24*b* of rim 24 that form the top edges of back panels 18 of trays 12. Section 126, 128 and 130 are provided with a pressure sensitive contact adhesive to adhere the sections to peripheral flange section 24*b*. As will be appreciated, sections 126, 128 and 130 are provided to the consumer in a tape form having release paper covering the contact adhesive of such sections. It should be pointed out that hook sections 28 and fleece sections 30, which are used to attach cover 26 to tray 12, also are provided in such tape form, but in a width dimension narrower than the tape used for forming sections 126, 128 and 130**.

As has been indicated for bracket member 64, tray 10 and the other components of wheel assembly 60 are all advantageously fabricated by plastic injection molding techniques. Additionally, all components of wheel assembly 60 and tray 12 are advantageously formed from the same material. A preferable material is polystyrene, although A.B.S., S.A.N. and N.A.S. plastic could function as a material for fabricating tray 12 and wheel assembly 60. Additionally, clear cover 26 is advantageously formed from a clear, flexible plastic sheet of vinyl.

Although the present invention has been illustrated relative to a rolling drawer, it is understood that the present invention has applicability beyond the design illustrated in the figures herein. For instance, front and back panels 16 and 18, as well as the top rim 24 forming the top edges of the front, back and side walls, could be deleted. Such a modified design for tray 12 could function as a dolly. As will also be appreciated, with suitable modification, tray 12 and wheel assemblies 60 could function in a standup cabinet or bureau as one of a series of drawers of such a cabinet or bureau.

It should further be mentioned that although rolling drawer 10 is illustrated as including two pairs of wheel assemblies 60, an embodiment is possible in which only one pair of such wheel assemblies 60, one pair of open ended slots 36 and one pair of associated cut-out openings 38 are provided. In such embodiment, each side panel 20 and 22 would have one cut-out opening 38, and bottom panel 14 would be provided with a pair of associated cut-out openings 38. Wheel assemblies 60 would be attached to each side of the tray of such an embodiment to support the tray for rolling movement. If it were desired that the tray remain in a level orientation, a depending member spaced either forwardly or rearwardly from wheel assemblies 60 could be attached to the bottom panel of the tray to contact and slide over the support surface.

While preferred embodiments of the invention have been shown and described in detail, it will be readily understood and appreciated that numerous omissions, changes and additions may be made without departing from the spirit and scope of the present invention.

We claim:

1. A rolling drawer for storing articles, said drawer comprising;

a drawer-like tray to store the articles including a bottom panel and a pair of upstanding side panels connected to the side edges of said bottom panel, said bottom panel having at least one cut-out opening formed along each of its side edges and said side panels each having an open ended slot communicating with a respective one of said cut-out openings and projecting upwardly therefrom;

at least one pair of wheel assemblies for supporting said tray for rolling movement upon a support suraace, each of said wheel assemblies comprising a wheel and a bracket member;

means for rotatably mounting said wheel to said bracket member;

said bracket member including an elongated plate having a width dimension greater than the corresponding width dimension of said open ended slots; and mounting means on said bracket member to removably mount a separate one of said wheel assemblies to each side of said tray, said mounting means configured to pass through one of said cut-out openings and engage the associated side panel when said bracket member is moved upwardly into a mounted position on said side panel.

2. The rolling drawer of claim 1 wherein said mounting means include a pair of oppositely disposed L-shaped mounting lugs projecting inwardly from the inner surface of said plate, the base legs of said lugs spaced from said inner plate surface and configured to engage the inner marginal surface portions of said side panel defining the edges of said open ended slot when said bracket member is moved to its mounted position.

3. The rolling drawer of claim 2 further comprising wedge-like elements on the inner surface of said plate and disposed along the side edges thereof, said plate elements configured to engage outer surface portions of the associated side panel with an increasing frictional engagement as said bracket member is moved to its mounted position.

4. The rolling drawer of claim 3 further comprising wedge-like elements on the base legs of said lugs and disposed in facing relation to the inner surface of said plate, said lug elements configured to engage inner surface portions of the associated side panel with an increasing frictional engagement as said bracket member is moved to its mounted position.

5. The rolling drawer of claim 2 wherein the side edges of said plate are formed having a pair of oppositely disposed and inwardly directed notched portions, said mounting lugs being disposed adjacent to said notched portions.

6. The rolling drawer of claim 3 wherein the side edges of said plate are formed having a pair of oppositely disposed and inwardly directed notched portions, said mounting lugs being disposed adjacent to said notched portions, and said wedge-like elements of said plate being disposed on either side of said notched portions.

7. The rolling drawer of claim 1 wherein said plate further includes an upper flange projecting inwardly from the inner surface of said plate, said flange configured to contact an upper marginal edge portion of the open-ended slot of the associated side panel to limit upward movement of said plate and define the mounted position of said bracket.

8. The rolling drawer of claim 1 wherein said plate further includes a lower flange projecting inwardly from the inner surface of said plate, said lower flange configured to block-off the associated cut-out opening of the bottom panel when said bracket is in its mounted position.

9. The rolling drawer of claim 1 wherein each of said wheels has a hub formed with a bore extending therethrough, said rotatable mounting means comprising a stub axle projecting outwardly from the outer surface of said plate, said axle configured to be freely received within said bore, and retaining means engaging said axle to prevent removal of said wheel from said axle when said wheel is rotatably mounted in place.

10. The rolling drawer of claim 9 wherein said axle is formed with a bore having a free end, and said retaining means comprises a pin having an enlarged head and a stem connected to said head, said stem being configured to be frictionally received within the bore of said axle with said pin head overlying the hub of said wheel.

11. The rolling drawer of claim 1 further comprising a dust cover removably mounted to the top of the tray to protect the articles stored therein.

* * * * *